US007788813B2

(12) United States Patent
Liu

(10) Patent No.: US 7,788,813 B2
(45) Date of Patent: Sep. 7, 2010

(54) HAND HELD CUTTER

(76) Inventor: Rebecca Wing Wing Liu, Room 1405, Block Q, Luk Yeung Sun Chuen, Tsuen Wan, New Territories, Hong Kong Special Administrative Region (CN)

( * ) Notice: Subject to any disclaimer, the term of this patent is extended or adjusted under 35 U.S.C. 154(b) by 251 days.

(21) Appl. No.: 12/092,438

(22) PCT Filed: Nov. 3, 2005

(86) PCT No.: PCT/CN2005/001839

§ 371 (c)(1),
(2), (4) Date: Jun. 26, 2008

(87) PCT Pub. No.: WO2007/051351

PCT Pub. Date: May 10, 2007

(65) Prior Publication Data

US 2009/0126203 A1 May 21, 2009

(51) Int. Cl.
*B26B 29/00* (2006.01)

(52) U.S. Cl. ..... 30/292; 30/319

(58) Field of Classification Search ..... 30/306, 30/307, 319, 292, 314, 317
See application file for complete search history.

(56) References Cited

U.S. PATENT DOCUMENTS 717,030 A * 12/1902 Sager ..... 30/292
3,048,921 A * 8/1962 Johnson ..... 30/292
4,062,116 A * 12/1977 Arnott ..... 30/292
5,101,564 A 4/1992 Melter
6,643,936 B2 11/2003 Carlson et al.

FOREIGN PATENT DOCUMENTS

| | | |
|---|---|---|
| CN | 2193796 Y | 4/1995 |
| CN | 1205263 A | 1/1999 |
| CN | 2306109 Y | 3/1999 |
| JP | 2005066755 A | 3/2005 |

* cited by examiner

*Primary Examiner*—Kenneth E. Peterson
(74) *Attorney, Agent, or Firm*—Scully, Scott, Murphy & Presser, P.C.

(57) ABSTRACT

The present invention relates to a hand held cutter (11) utilizing auxiliary wheels (9) individually performing two working modes including cuts along a rectilinear path and a desired curved path. By switching a control, a pair of auxiliary wheels (9) shifts the cutter (11) from one working mode to one another. According to the unique design of the present invention, a circular disk-shaped cutting blade (14) mounted on the side edge of the pair of auxiliary wheels (9) can produce a stable and versatile cutting effects under the guidance of the auxiliary wheels (9). The application and breakthrough of technologies reduce the size of the hand held cutter (11) so that the cutter 11 can be conveniently carried around.

2 Claims, 4 Drawing Sheets

HAND HELD CUTTER

FIELD OF INVENTION

The present invention relates to a hand held cutter 11, which utilizes auxiliary wheels 9. The hand held cutter 11 according to the present invention operates in two working modes: to cut independently along a rectilinear path and to cut flexibly along a desired curved path just like some conventional cutters 11.

BACKGROUND ART

A cutter 11 having the function of independently cutting along rectilinear path is seldom at the present-day market. One of the products having such function is a cutter 11 disclosed in the Chinese published patent application No. 98116050.6. The paper cutting machine has a board which is provided at one end thereof with a rail support for supporting a rail. A slider is movably provided on the rail. A rotatable cutter blade is attached to the slider. A member made of a single material constitutes a sliding block, which lowers the cost of the sliding block, and meanwhile, since the sliding block itself is provided with a safety member, a rotatable blade can be easily changed by changing the sliding block integral with the rotatable blade. According to the said cutter, it is heavy and bulky due to a large size.

On the other hand, cutters 11 having a function of cutting along desired curved path accounts for a higher market share, but their safety and stability somehow are hard to master. In that sense, cutter 11 designed with cutting modes both along rectilinear path and desired curved path is even seldom. In view of the above-mentioned drawbacks of the prior art cutters 11, a technical solution regarding a novel hand held cutter 11 is conceived in the present invention.

SUMMARY OF THE INVENTION

The cutter 11 according to the claim no. 1 can flexibly and independently operate and shift between working modes; cutting along a rectilinear path and cutting along a desire path. According to the present invention, a user can use the cutter 11 to work without interruption with a tool having the smallest size.

The present invention according to claims no. 1 and no. 3 provides a hand held cutter 11 using auxiliary means for guidance and using a cutting blade 14 to perform cutting, the auxiliary means comprises:

a) at least one auxiliary wheel 9 b) an interface means 17 or the like with similar function mounted between auxiliary wheels 9.

The said auxiliary means, when the auxiliary wheels 9 are pushed and/or pulled rolling on the article to be cut, controls relative motion between a pair of auxiliary wheels 9 which are directly or indirectly contacting with each other to generate two working modes: cutting along a rectilinear path or a desired curved path.

The operation of the said interface means 17 utilizes an inner ring gear or gear assembly controlled by external force to simultaneously lock onto or respectively disengage from gears on shaft stem 13 of the auxiliary wheels 9:

When the interface means 17 locked the auxiliary wheels 9, the auxiliary wheels 9 can synchronously roll at the same speed and in the same direction to generate the rectilinear path.

Conversely, when the interface means 17 disengaged from the auxiliary wheels 9, the repression of the auxiliary wheels 9 from the interface means 17 immediately disappears and the auxiliary wheels 9 can individually roll to generate a desired curved path.

IMPLEMENTATION OF THE INVENTION

Figure 1:
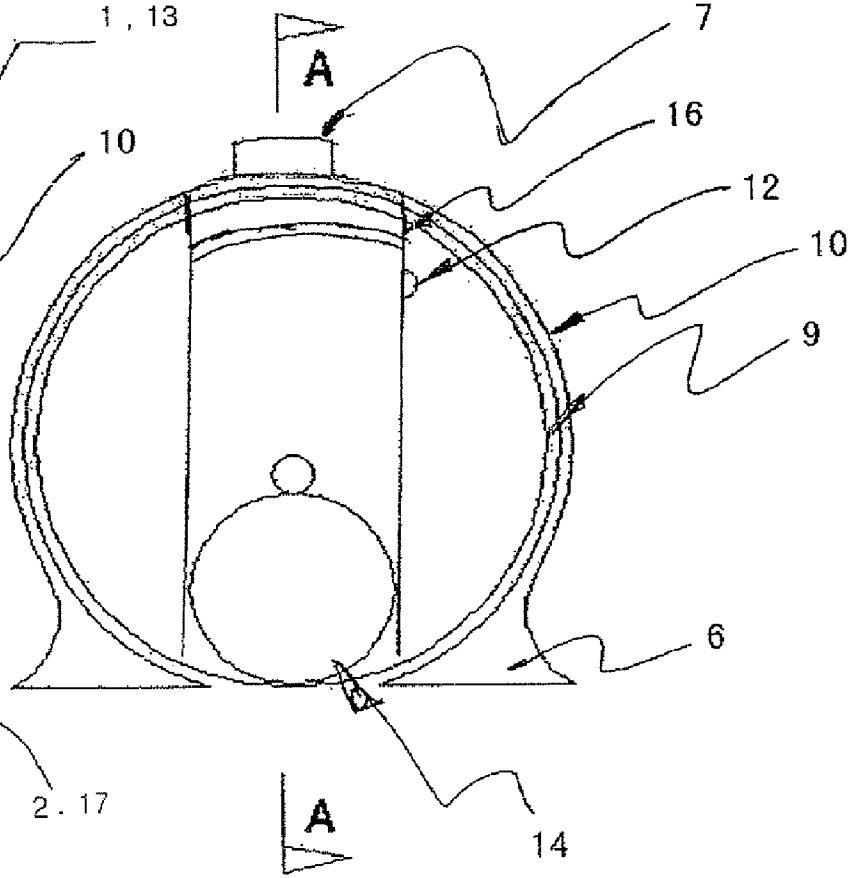
FIG. 1 is a schematic view of the cutter according to the present invention
Figure 2:
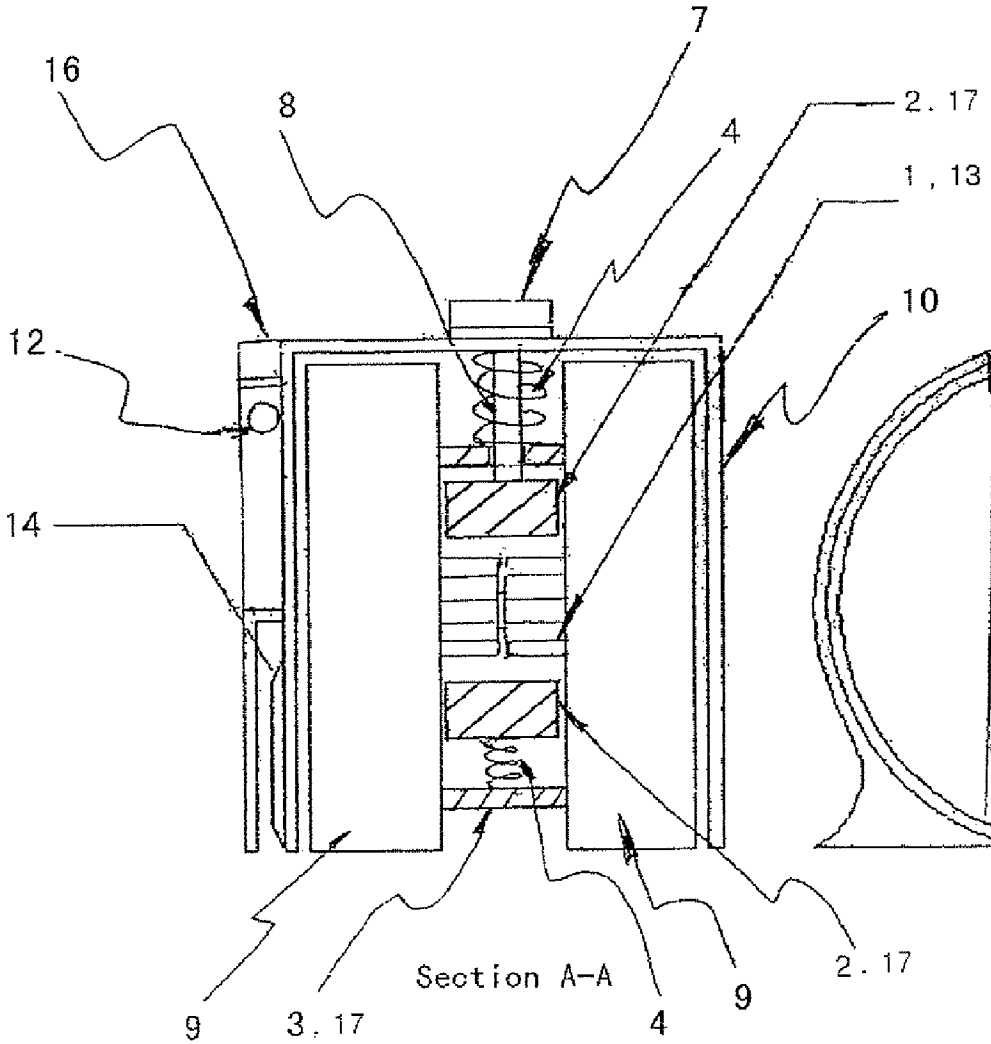
FIG. 2 is a cross-sectional view of the cutter according to the present invention

The cutter 11 according to the claims no. 1 and 3 comprises a cutter blade 14 and auxiliary means. As shown in FIG. 1, the present invention utilizes a circular disk-shaped cutting blade 14, which characterized in a rotatably and firmly attached to a central shaft, wherein blade edge is at the circumference. The cutting blade 14 can be continuously and repeatedly used, furthermore, all of the edge can be utilized equally, so that the cycle for grinding can be prolonged.

Besides, the assembly of auxiliary wheels 9 of the cutter 11 is crucial for providing more that one working modes and modes-shifting mechanism. Among the above-mentioned working modes, cutting along a rectilinear path requires the following two conditions:

1) the cutter 11 can display the direction of the rectilinear path 2) the cutter 11 can independently operate along a rectilinear path when being push and/or pull.

The cutter 11 can be shifted between both working modes wherein the assembly of auxiliary wheels 9 must meet another additional condition:

3) mechanism of disengaging and re-engaging the assembly during mode shifting.

The above three perquisites constitute the essence of the present invention. The following paragraphs describe how the present invention provide corresponding solutions in view of above items 1) and 2) and 3).

1) The direction display 12 utilizes the prior art optical technology. The direction display 12, laser line generator, is mounted above the circular disk-shaped cutting blade 14, as shown in FIG. 1. The direction display 12 and the cutting blade 14 are aligned with a straight vertically line. A user only needs to press down a button 16 of the direction display 12 above the auxiliary wheels 9. The direction display 12 projects a beam of laser-like concentrated light, which accurately indicates the direction in which the cutting is heading. The user moves the continuous light of the cutter 11 closer to or to overlap the path of cutting. As such, the user can accurately know whether the cutter 11 moves along his or her intended path, and then slightly refine the direction in which the cutter 11 is heading. After the cutter 11 is aligned with the target path, the button 16 of the direction display 12 is released and the direction display 12 is switched off. The adjustment does not required aid of other accessories. The cutter 11 is always kept in the user's hand so as to more effectively accomplish the task.

2) Under the working mode along a rectilinear path, the cutter 11 is pointed at an intended direction; the cutter 11 can be pushed or pulled to cut a sheet of paper or other materials. The prime prerequisite for cutting along a rectilinear path according to the present invention lies on the use of the multi-contact point principle during operation. The interfaces of pair of auxiliary wheels 9 and the circular disk-shaped cutting blade 14 with the surface of article are forming the multi-contact points.

According to claim no. 4, the cutter 11 relies on the anti-slide material on the surface of the auxiliary wheels, such that the working modes can be ensured.

3) As stated in 2), the rotation of the auxiliary wheels 9 in the cutting mode along the rectilinear path is restricted. When the cutter 11 of this invention is shifted to the mode of cutting along a desired curved path, the pair of auxiliary wheels 9 must be allowed to rotate independently, whereupon the auxiliary wheels 9 can be synchronous or asynchronous. More freedom is endowed to the auxiliary wheels 9. To help a user repeatedly shift between operating modes, a disengaging and re-engaging means needs to be developed between the shaft stem 13 and the interface means 17.

Arrangement of the System

Figure 3:
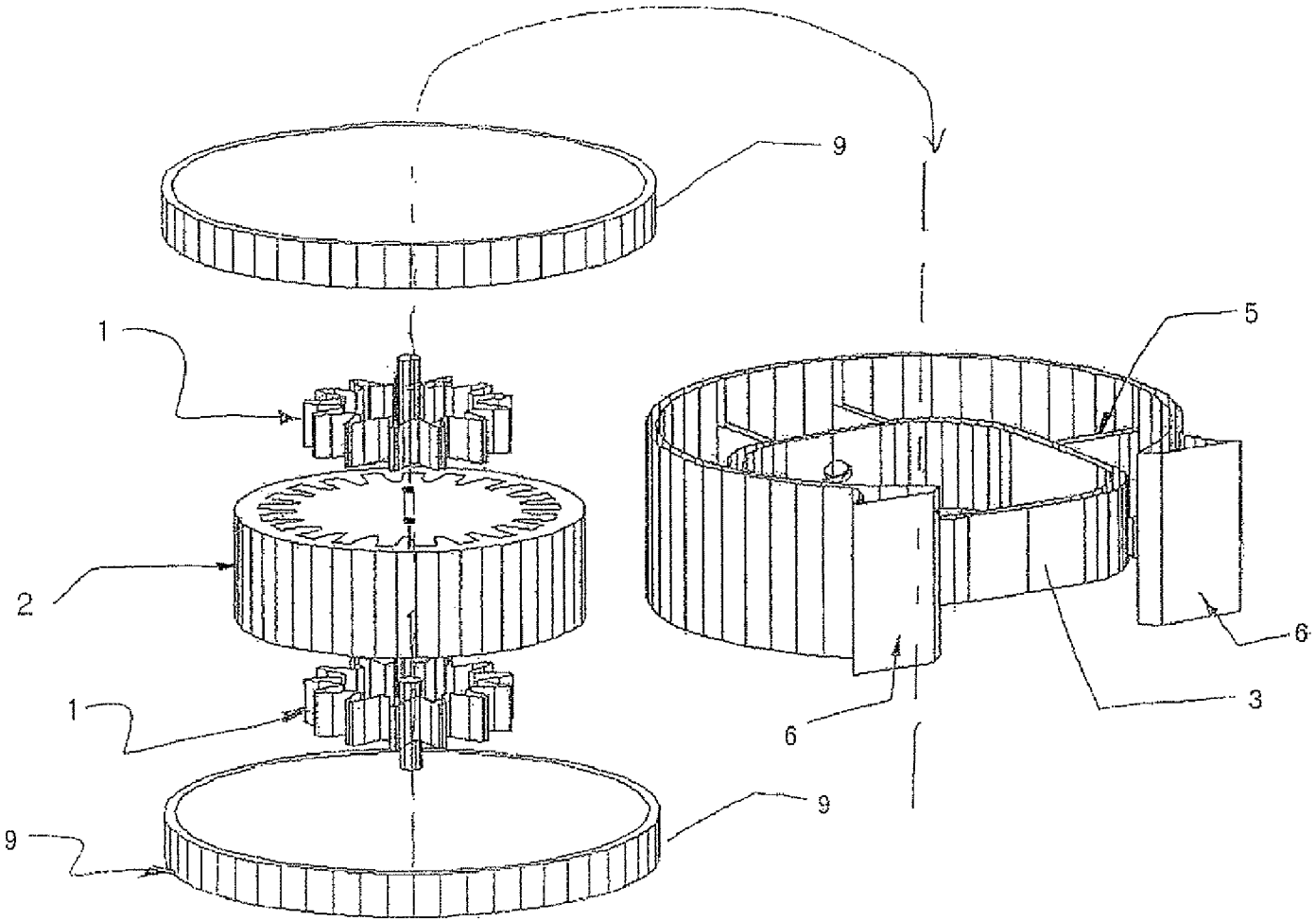
FIG. 3 is a schematic perspective view of interface means or gear assembly

Independent rotation or synchronous rotation of the pair of auxiliary wheels 9 can be achieved by utilizing the interface means 17 comprising inner ring gear 2. The inner ring gear 2 is specially placed in a small chamber 3 as shown in FIG. 3. The inner ring gear 2 is sized to closely abut against and supported by four walls of the small chamber 3. Pair of coil springs 4 respectively are placed against inner ring gear at the top and bottom to ensure the inner ring gear 2 back to its normal position. Thus, the inner ring gear 2 does not have a fixed position in the small chamber 3. The inner ring gear 2 is pressed by an external force from control rod 8 to float upwardly or downwardly in the small chamber 3, meanwhile the inner ring gear 2 can freely rotate along its horizontal axle.

Figure 4:
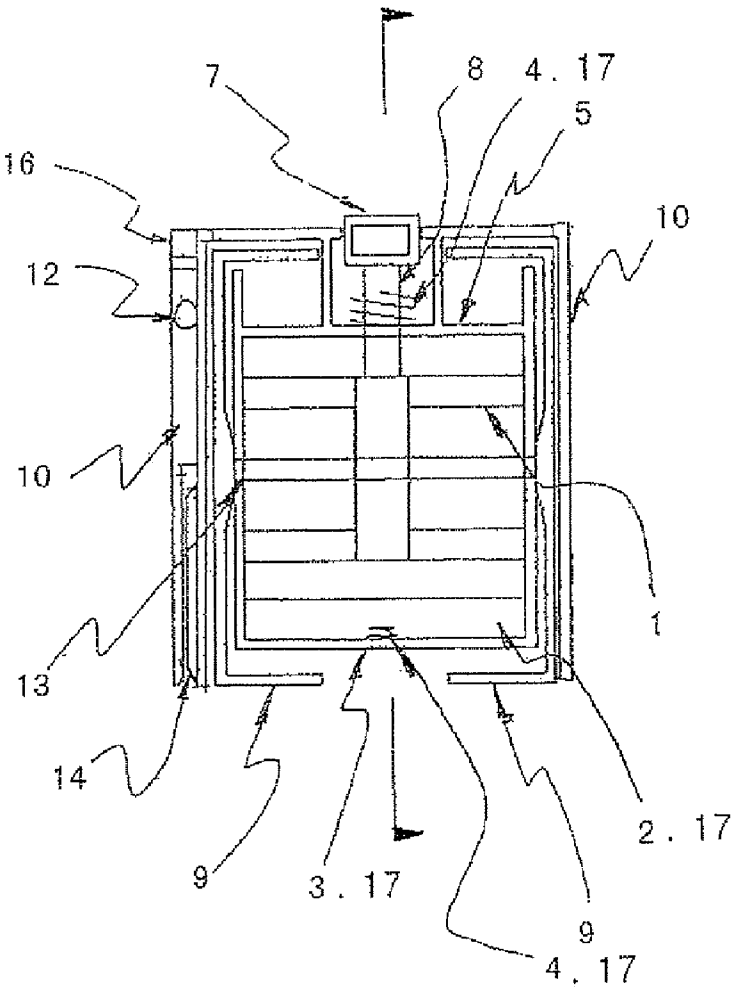
FIG. 4 is cross-sectional view of the cutter
Figure 5:
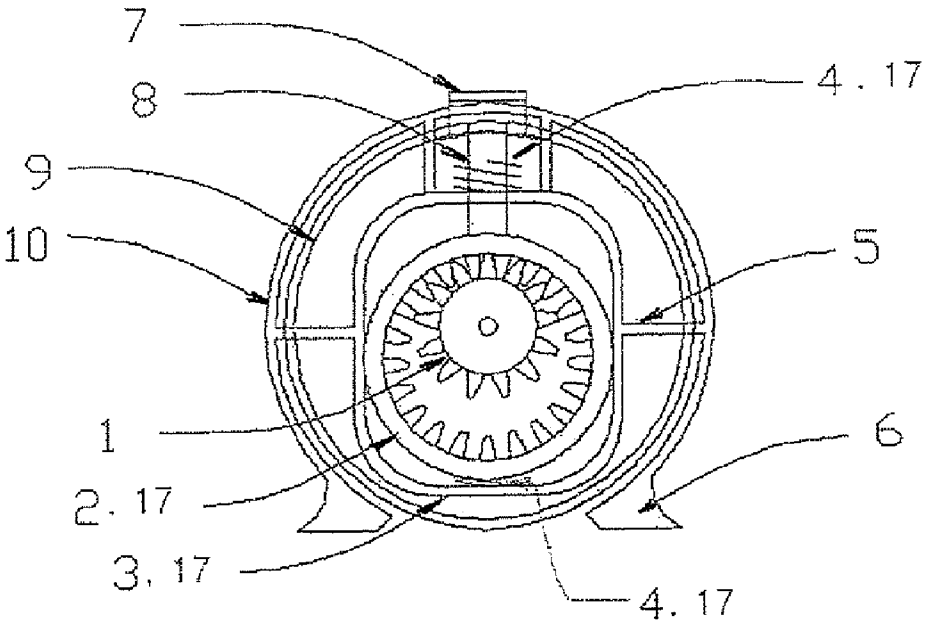
FIG. 5 is a schematic view of gear assembly of the cutter in the cutting mode along a rectilinear path
Figure 6:
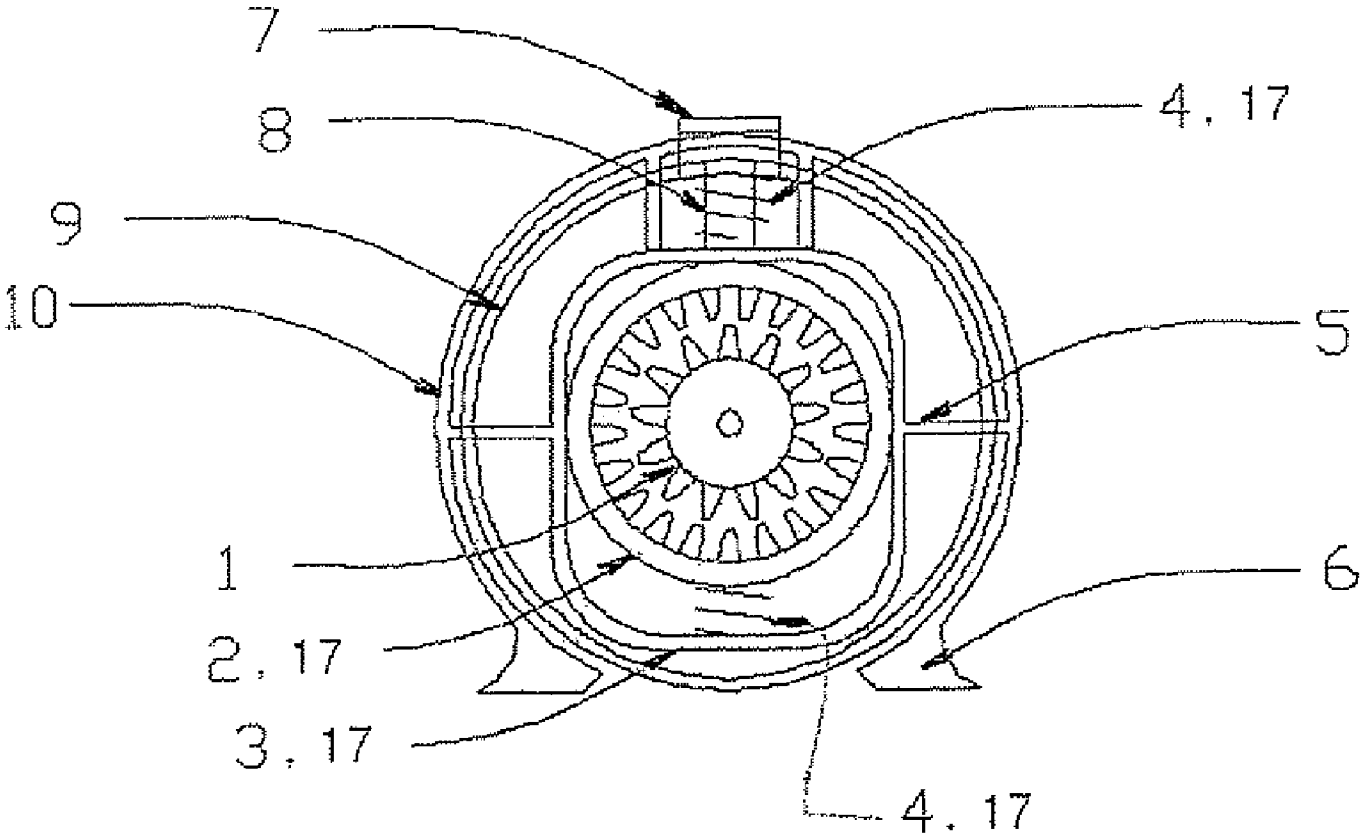
FIG. 6 is a schematic view of gear assembly of the cutter in the cutting mode along a desired curved path

To cope with the necessity of independent rotation of the pair of auxiliary wheels 9, the shaft stem 13 is modified. The shaft stem 13 must be segmented into two sections. The two auxiliary wheels 9A and 9B are respectively attached to one of the sections of the shaft stem 13, another end of each section of shaft stem 13 which is cast into gear or provided with pinion 1 is inserted the small chamber 3 through an aperture preset on both sides of the small chamber 3. The distal ends of the two sections of the shaft stem 13 do not directly contact with each other. A small rod 18 functioning to hold shaft stem in a horizontal position links the two sections of the shaft stem 13. Therefore, the two pinions 1 can be securely attached to the walls of the small chamber 3. The pinion 1 can only freely rotate about its own rotation axle, as shown in FIGS. 4 and 6.

The inner ring gear 2 serves as a connecting interface of the two sections of shaft stem 13 of auxiliary wheels 9, and the teeth of the inner ring gear 2 and the pinions 1 are in contact with one another. Conversely, the interface can completely by away from the pinions 1 on the shaft stem 13. The point is that the diameter of the inner ring gear 2 must be greater that that of the pinions 1, the ratio thereof is: 1D (diameter of inner ring gear 2)>2d (diameter of the pinions 1), as shown in FIGS. 4 and 6.

a. Arrangement for gear assembly in cutting mode along a desired curved path In the cutting mode along a desired curved path, the mode-shifting button 7 is in a normal state and the position of the pinions 1 and the inner ring gear 2 are concentric. Since the diameter of the inner ring gear 2 must be greater than that of the pinions 1, the teeth of the inner ring gear 2 and pinions 1 by no means contact with one another. As shown in FIG. 3, the two auxiliary wheels 9 are completely away from the interface so that they can individually rotate.

b. Arrangement for gear assembly in cutting mode along a rectilinear path Conversely, in cutting mode along a rectilinear path, the inner ring gear 2 is pressed by an external force to move downwardly so that the teeth of the inner ring gear 2 and the pinions 1 closely contact one another, as shown in FIG. 4. The rotation direction and speed of the auxiliary wheel 9A is transmitted (transfer) to the auxiliary wheel 9B via the inner ring gear 2; conversely the rotation direction and speed of the auxiliary wheel 9B is transmitted to the auxiliary wheel 9A via the inner ring gear 2. In this condition, the pair of auxiliary wheels 9 can synchronously rotate, and the cutter 11 can meet the requirement for independently cutting along a rectilinear path.

The invention claimed is:

1. A hand held cutter (11) having an auxiliary means (17) for guidance and having a cutting blade (14) to perform a cutting operation on an article, the auxiliary means comprising;

first and second independent auxiliary wheels (9) and an interface means (17) mounted between said first and second independent auxiliary wheels (9), said interface means comprising;

a first gear attached to the first auxiliary wheel, a second gear attached to the second auxiliary wheel, an internally toothed ring gear surrounding said first and second gears, an operator engagement mechanism to move the ring gear between a first position where it engages the first and second gears, and a second position where it does not engage the first and second gears, wherein, when in the first position, the two independent auxiliary wheels (9) rotate synchronously at the same speed in the same direction to generate a rectilinear path for the cutter, wherein, when in the second position, the first and second auxiliary wheels (9) can individually roll to generate a desired curved path for the cutter.

2. The hand held cutter 11 according to claim 1, characterized in that the auxiliary means comes into contact with the surface of the article to be cut via the first and second auxiliary wheels (9), the auxiliary wheels (9) having a surface made of an anti-slide substance.

* * * * *